United States Patent [19]

Ford

[11] Patent Number: 4,890,808

[45] Date of Patent: Jan. 2, 1990

[54] MULTIPLE ROD CENTER SUPPORT

[76] Inventor: Alan A. Ford, 62669 Balk Road, Sturgis, Mich. 49091

[21] Appl. No.: 308,620

[22] Filed: Feb. 10, 1989

[51] Int. Cl.[4] ..... A47H 1/10

[52] U.S. Cl. ..... 248/263; 211/103; 211/105.1; 248/253; 248/255

[58] Field of Search ..... 248/251, 261, 263, 262, 248/266, 273, 255, 256, 259, 254; 160/38; 211/105, 103

[56] References Cited

U.S. PATENT DOCUMENTS

| | | | |
|---|---|---|---|
| 1,149,466 | 8/1915 | Pranis | 248/259 |
| 2,293,662 | 8/1942 | Richardson | 248/263 X |
| 3,119,442 | 1/1964 | Ford et al. | 248/262 X |
| 3,346,227 | 10/1967 | Hankin | 248/262 |
| 4,316,547 | 2/1982 | Varon | 248/251 X |
| 4,694,532 | 9/1987 | Black | 248/263 X |

*Primary Examiner*—Ramon O. Ramirez

*Attorney, Agent, or Firm*—Kenyon & Kenyon

[57] ABSTRACT

A rod center support system for supporting a portion of at least one rod comprises a support base having a first end and a second end with the first end being configured for attachment to a support structure, a drop strap having a first portion for connection to the second end of the support base and a second portion downwardly depending from the first portion. At least one adjustable, self-locking clip member is slidably received by the second drop strap portion and may be locked into any predetermined position along the length of the second drop strap portion by means of a surface formed in a drop strap engaging end section of the self-locking member that is angularly disposed with respect to the main portion of the member. The clip includes a tab for supporting a portion of a rod. The rod center support system may be used to support the center portions of multiple curtain rods used to form a valance.

22 Claims, 2 Drawing Sheets

MULTIPLE ROD CENTER SUPPORT

BACKGROUND OF THE INVENTION

The invention relates generally to valances and more particularly to a rod center support system for supporting a portion of at least one of the curtain rods used to form the valance.

Decorative headings used to conceal the top of curtains, windows or both, commonly referred to as valances, are often comprised of curtain rods that are stacked one on top of the other, with or without vertical spacing therebetween, to obtain a layered look. A decorative sheath or fabric covers the curtain rods, each of which are typically supported by brackets at the rod ends. The end brackets are fixedly secured to a wall or other supporting structure. As the length of the rods increases, it becomes necessary to support the center of each rod to prevent sagging. It is known in the art to support the center of each rod with a respective center bracket mounted to the wall in a manner similar to the end brackets. The disadvantages of such a support system are apparent. Use of individual center brackets increases the number of brackets that must be attached to the wall, often by an awkward screw connection procedure that becomes increasingly difficult as more rods are used to form the valance. Furthermore, this type of system limits the mounting possibilities of the multiple rod valance. For example, none of the rods can overlap the adjacent window because the center bracket, as a practical matter, cannot be fixedly attached to the window pane.

The invention is directed to providing a simple and efficient rod center support system for supporting the center rod portions of a multiple rod valance that avoids the foregoing disadvantages of the prior art.

SUMMARY OF THE INVENTION

The invention relates to a rod support system for supporting a portion of at least one rod, typically the center portion of the rod. The system comprises a support base having one end configured for connection to a supporting structure, such as a wall, and another other end configured for connection to a drop strap. The drop strap slidably receives at least one height adjustable, self-locking clip member that typically supports the center portion of the rod.

The rod support system of the invention is particularly adapted to support a plurality of curtain rods used to form a valance. The rods may be stacked one on top of each other or may be vertically spaced from each other. A plurality of adjustable, selflocking members support respective portions of the rods, typically the center portions, by means of a tab-recess connection between the clip member and the rod. The recesses of the rods may be formed either as a slot or as a lip.

With the support system of the invention, a single wall-bracket connection can support the center of a plurality of rods. This facilitates the ease with which the rods may be connected to the center support. For example, the invention obviates the need for often ackward and difficult screw-type connections that heretofore have been used to support the center portions of the rods. This is particularly advantageous in minimizing the difficulty encountered in attaching a plurality of rods to a center supporting structure, as the attachment difficulty increases both as the number of rods employed increase and as the vertical spacing between the rods decreases.

Furthermore, the support system of the invention increases the mounting possibilities of a multiple rod valence. With the single wall-bracket connection of the invention, more rods may be used in the valance and the rods may be arranged to overlap the windows in a manner that heretofore was not possible with use of individual center brackets for supporting each rod. Thus, one or more of the rods may be disposed adjacent a window of the supporting structure while support of the center portions of these rods occurs in a manner that is more simple, efficient and aesthetically pleasing than heretofore possible.

The above is a brief discussion of certain problems associated with the prior art and some of the advantages of the invention described herein. Other advantages of the invention will become apparent from the detailed description and claims set forth below.

DETAILED DESCRIPTION

Figure 1:
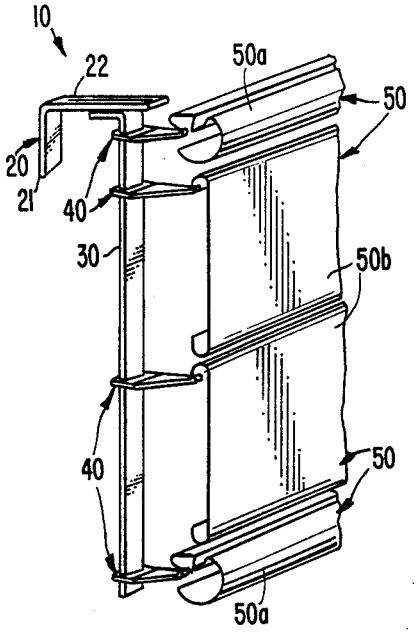
FIG. 1 is a perspective view of a multiple rod center support system constructed according to the principles of the invention illustrating connection of the center portions of a plurality of rods to the support system.
Figure 8:
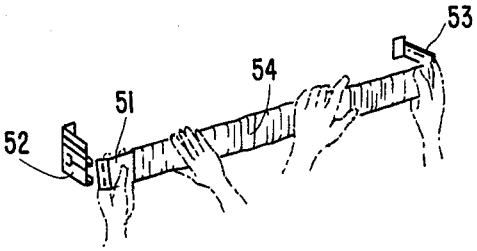
FIG. 8 is a perspective view of a curtain rod that may be supported with the multiple rod center support of the invention.

The multiple rod center support system 10, shown in perspective in FIG. 1, supports the centers of a plurality of curtain rods 50. Rods 50 may form a valance or decorative top treatment for a window. For purposes of clarity, only a part of the center portion of each rod is illustrated in FIG. 1. In addition, the decorative fabric that may be arranged over each rod, such as the fabric 54 shown in FIG. 8 covering rod 51, has been omitted from FIG. 1. The center of each of the rods 50 is supported by the multiple rod center support system 10 as well as by end brackets, such as brackets 52 and 53 illustrated in FIG. 8. The end brackets typically are attached to a wall or other supporting structure above a window in the wall.

Figure 2:
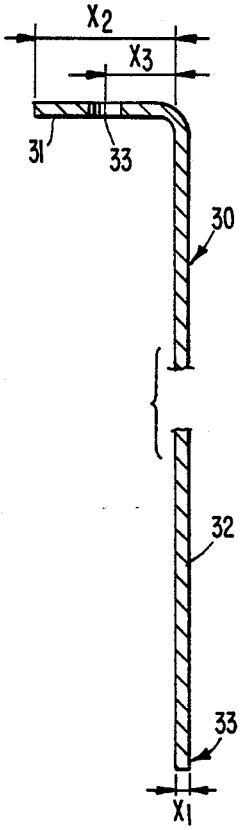
FIG. 2 is a cross sectional view of the drop strap of the multiple rod center support system of the invention.
Figure 3:
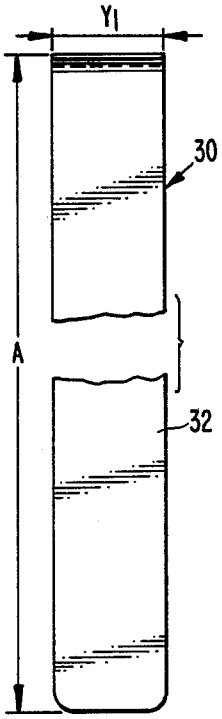
FIG. 3 is a front view of the drop strap illustrated in FIG. 2.

The multiple rod center support system 10 comprises a support base 20 that is generally formed from two orthogonal portions 21 and 22. Portion 21 may be mounted to a wall or other supporting structure by means of a screw connection (not illustrated). The top portion 22 of support base 20 contains an aperture (not shown) that is alignable with a corresponding aperture 33 formed in the top portion 31 of drop strap 30, as shown in FIG. 2. The support base and drop strap may be connected together in this manner by means of a nut and bolt connection (not shown).

The ends of the rods 50 are supported by means of brackets (not shown in FIG. 1) as previously mentioned. The multiple rod center support system is adapted to support different type of rods, such as the round rods 50*a* and the flat rods 50*b* illustrated in FIG. 1. The center portion of each rod 50 is supported by means of an adjustable, self-locking clip 40. A representative clip 40 is described in more detail below with reference to FIGS. 4–7.

Figure 4:
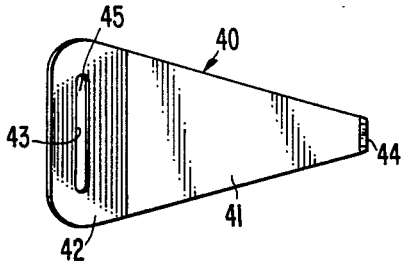
FIG. 4 is a top plan view of a representative adjustable clip illustrated in FIG. 1.
Figure 5:
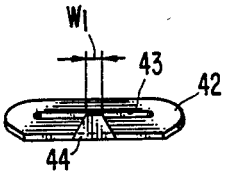
FIG. 5 is a front view of the adjustable clip shown in FIG. 4.
Figure 6:
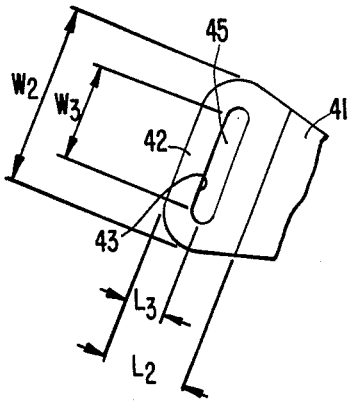
FIG. 6 is a partial top view of the locking portion of the adjustable clip of the invention.
Figure 7:
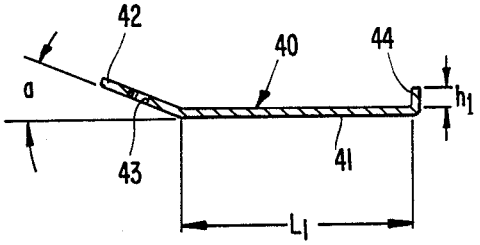
FIG. 7 is a cross sectional view of the adjustable clip shown in FIGS. 4–6.

As shown best in FIG. 4, clip 40 comprises three sections: a substantially flat middle portion 41, a substantially flat, angled locking portion 42 and a tab portion 44 that upwardly projects from clip portion 41 in a substantially perpendicular manner as shown, for instance, in FIG. 7. Locking portion 42 is disposed at an angle a, which in one preferred embodiment may have a value of 22°, to provide the self-locking feature of the clip. Locking portion 42 includes an elongated slot or aperture 45 having a surrounding edge surface 43. It is not necessary for edge surface 43 to completely surround drop strap portion 32 and other arrangements such as a key-way type opening may be employed. The dimensions of the slot are selected such that the clip 40 may fit over end portion 33 of drop strap portion 32 such that the clip may easily be slid up the drop strap portion 32 to any predetermined position along the length A of drop strap portion 32.

The small bend between clip portions 41 and 42 defined by angle a enables the clip to perform a wedge-like locking function after it is slid up drop strap 30 to a predetermined position. The clip is easily slid up drop strap 32 by aligning locking portion 42 with the horizontal as the clip is slid to its predetermined position along drop strap portion 32. When the clip reaches a predetermined position it is released such that the edge surface 43 of the aperture 45 frictionally engages and positively locks against the walls of strap portion 32 under the weight of the clip itself. In the locked position, the middle clip portion 41 is substantially aligned with the horizontal and the locking portion 42 is angled, such as shown in FIG. 7. The clip occupies a predetermined position when tab 44 is received in a corresponding recess or underneath the lip of a rod as shown in FIG. 1. The weight of the rod on the clip causes the surface 43 to further bite into drop strap portion 32 to more fixedly secure the clip 40 to the drop strap 32 thereby enhancing the self-locking feature.

Drop strap 30 may be preferably formed from a steel strip that is coated with vinyl or other suitable deformable material, such as a rubber, elastomeric or polyster material, that further increases the frictional engagement between the drop strap portion 32 and the surface 43. Clip 40 and hence surface 43 may be formed from uncoated, plated steel to enable the relatively sharp edges of surface 43 to frictionally engage and possibly deform the vinyl coated strap portion 32 to increase the positive locking action therebetween.

The ease with which the center portions of rods 50 may be attached to multiple rod center support system 10 is readily apparent. One merely slides an adjustable clip 40 into a predetermined position along drop strap 30 until tab 44 is received in the corresponding rod recess or underneath the rod lip, as previously discussed. The self-locking feature enables the clip to be easily and firmly locked in any predetermined position along the length A of strap 30. Thus as shown in FIG. 1, this greatly facilitates the attachment of a plurality of stacked rods to support system 10.

The length L1 of clip portion 41 may be varied in order to produce both long and short clips for advantageously attaching different type of rods, such as the round rods 50*a* which preferably are attached with short clips and the flat rods 50*b* which preferably are attached with long clips. In one preferred embodiment of the invention, the length L1 of the long clip is approximately 1.562 inches and the length L1 of a short clip is approximately 1.125 inches. The remaining dimensions of the short and long clips 40 may be identical. The values of these dimensions for one preferred embodiment are set out below:

$h_1$, $w_1$=0.125 inches
$l_2$=0.562 inches
$l_3$=0.250 inches
$w_2$=1.187 inches
$w_3$=0.687 inches
Angle a =22°.

In addition, preferred dimensions for the drop strap 30 are set out below:

$x_1$=0.093 inches
$x_2$=0.906 inches
$x_3$=0.437 inches
$y_1$=0.750 inches

The longitudinal dimension A may differ according to the number of rods that are to be supported by the multiple rod center support 10. For instance, dimension A be either 7.00 inches or 11.75 inches depending upon the number of rods to be supported. All of the foregoing dimensions are approximate, subject to standard tolerances and do not account for vinyl coating of the drop strap. In addition, the curved portions of the drop strap 30 and clips 40 may be appropriately rounded as illustrated in the drawings.

What is claimed is:

1. A rod center support system for supporting a portion of at least one rod comprising:

a support base having a first end and a second end, said first end being configured for attachment to a supporting structure;

a drop strap having a first portion for connection to the second end of the support base and a second portion downwardly depending from said first portion;

an adjustable, self-locking member for slidably engaging the second portion of the drop strap, said member defining a tab for supporting a portion of a rod, said selflocking member configured to slide along the length of said second drop strap portion and be locked into a predetermined position; and wherein said adjustable, self-locking member comprises a substantially flat, middle portion, a drop strap engaging end section disposed at a predetermined angle with respect to said middle portion and defining a surface that at least partially circumscribes a second portion of the drop strap.

2. The rod support system of claim 1 wherein said tab extends from an end of said middle portion distal from said drop strap engaging end section and is substantially perpendicular to said middle portion.

3. The rod support system of claim 1 wherein said surface of the drop strap engaging end section of the adjustable, self-locking member that at least practically circumscribes the second portion of the drop strap comprises an aperture.

4. The rod support system of claim 1 wherein said drop strap is formed from a steel strip coated with a deformable material and said adjustable, self-locking member is formed from plated steel, said partially circumscribing surface including an edge frictionally engaging the coated drop strap after the adjustable, self-locking member is predeterminately positioned along the second drop strap portion.

5. The rod support system of claim 4 wherein said predetermined angle is approximately 22°.

6. The rod support system of claim 1 further comprising a plurality of adjustable, self-locking members each supporting a respective portion of one of a plurality of vertically stacked rods.

7. The rod support system according to claim 6 wherein said rods are curtain rods of a valance, each curtain rod having a central recess into which a respective tab of said adjustable, self-locking members is received.

8. The rod support system of claim 7 wherein at least one of said rods is disposed adjacent a window of a supporting structure.

9. The rod support system of claim 7 wherein at least one of said recesses is formed as a slot in a generally round rod.

10. The rod support system of claim 7 wherein at least one of said recesses is formed as a lip in a generally flat-shaped rod.

11. A rod center support system for supporting a portion of at least one rod comprising:

a support base having a first end and a second end, said first end being configured for attachment to a supporting structure;

a drop strap having a first portion for connection to the second end of the support base and a second portion downwardly depending from said first portion;

an adjustable, self-locking member for slidably engaging the second portion of the drop strap, said member defining a tab for supporting a portion of a rod, said selflocking member configured to slide along the length of said second drop strap portion and be locked into a predetermined position;

said member having a drop strap engaging section movable between a locked position and an unlocked position where said member extends at a first angle to said drop strap in said locked position and extends at a second angle from said drop strap in said unlocked position;

said engaging section cooperating with said drop strap to confine movement of said engaging section along a vertical path defined by said drop strap; and said engaging section further configured to permit movement along said path defined by said drop strap in an unlocked position and prohibit said movement in a locked position wherein said locked position being the position of said member in its natural condition.

12. A multiple rod center support and valance comprising:

a first rod having ends supported by a first pair of brackets configured for attachment to a supporting structure;

a second rod disposed vertically above said first rod and having ends supported by a second pair of brackets configured for attachment to a supporting structure;

a support base disposed intermediate said first and second pairs of brackets, said support base having a first end and a second end, said first end being configured for attachment to a supporting structure;

a drop strap having a first portion for connection to the second end of the support base and a second portion downwardly depending from said first portion; and first and second adjustable, self-locking members for slidably engaging the second portion of the drop strap, said members each defining a respective tab supporting a portion of one of said rods, said adjustable, self-locking members configured to slide along the length of said second drop strap portion and be locked into predetermined spaced positions.

13. The multiple rod support and valance of claim 12 wherein each of said adjustable self-locking members comprises a substantially flat, middle portion, a drop strap engaging end section disposed at a predetermined angle with respect to said middle portion and defining a surface that at least partially circumscribes the second portion of the drop strap.

14. The multiple rod support and valance of claim 13 wherein each of said tabs extends from an end of said middle portion distal from said drop strap engaging end section and is substantially perpendicular to said middle portion.

15. The multiple rod support and valance of claim 13 wherein said surface of the drop strap engaging end section of each adjustable, self-locking member that at least partially circumscribes the second portion of the drop strap comprises an aperture.

16. The multiple rod support and valance of claim 13 wherein said drop strap is formed from a steel strip coated with a deformable material and said adjustable, self-locking members are formed from plated steel, with each partially circumscribing surface including an edge frictionally engaging the coated drop strap after the adjustable, self-locking members are predeterminately positioned along the second drop strap portion.

17. The multiple rod support and valance of claim 16 wherein said predetermined angle is approximately 22°.

18. The multiple rod support and valance of claim 13 further comprising third and fourth adjustable, self-locking members each supporting a respective portion of one of third and fourth vertically stacked rods.

19. The multiple rod support and valance according to claim 18 wherein said rods are curtain rods, each of which has a central recess into which a respective tab of said adjustable, self-locking members is received.

20. The multiple rod support and valance of claim 19 wherein at least one of said rods is disposed adjacent a window of said supporting structure.

21. The multiple rod support and valance of claim 19 wherein at least one of said recesses is formed as a slot in a generally round rod.

22. The multiple rod support and valance of claim 19 wherein at least one of said recesses is formed as a lip in a generally flat-shaped rod.

* * * * *